US010637161B2

(12) United States Patent
Wu et al.

(10) Patent No.: US 10,637,161 B2
(45) Date of Patent: Apr. 28, 2020

(54) INTEGRATION OF CIRCUIT AND ANTENNA IN FRONT END

(71) Applicants: Ke Wu, Montreal (CA); Srinaga Nikhil Nallandhigal, Montreal (CA)

(72) Inventors: Ke Wu, Montreal (CA); Srinaga Nikhil Nallandhigal, Montreal (CA)

(73) Assignee: HUAWEI TECHNOLOGIES CANADA CO., LTD., Kanata (CA)

( * ) Notice: Subject to any disclaimer, the term of this patent is extended or adjusted under 35 U.S.C. 154(b) by 203 days.

(21) Appl. No.: 15/582,437

(22) Filed: Apr. 28, 2017

(65) Prior Publication Data

US 2018/0316100 A1 Nov. 1, 2018

(51) Int. Cl.

| | |
|---|---|
| ***H01Q 25/00*** | (2006.01) |
| ***H01Q 25/04*** | (2006.01) |
| ***H01Q 5/342*** | (2015.01) |
| ***H01Q 21/06*** | (2006.01) |
| ***H01Q 21/00*** | (2006.01) |
| ***H01Q 23/00*** | (2006.01) |
| ***H01Q 5/50*** | (2015.01) |

(Continued)

(52) U.S. Cl.

CPC ..... *H01Q 25/005* (2013.01); *H01Q 5/307* (2015.01); *H01Q 5/342* (2015.01); *H01Q 5/50* (2015.01); *H01Q 9/0407* (2013.01); *H01Q 21/0006* (2013.01); *H01Q 21/061* (2013.01); *H01Q 23/00* (2013.01); *H01Q 25/04* (2013.01)

(58) Field of Classification Search

CPC ..... H01Q 25/005; H01Q 5/307; H01Q 5/342; H01Q 5/50; H01Q 21/0006; H01Q 21/061; H01Q 23/00; H01Q 25/04

See application file for complete search history.

(56) References Cited

U.S. PATENT DOCUMENTS 5,614,863 A * 3/1997 Pierro ..... H03F 3/245 330/1 R
6,246,295 B1 * 6/2001 Matsui ..... H01Q 9/0407 331/117 D (Continued)

FOREIGN PATENT DOCUMENTS

| | | | |
|---|---|---|---|
| CN | 101740874 | A | 6/2010 |
| EP | 1037307 | A2 | 9/2000 |
| JP | 2010004457 | A | 1/2010 |

OTHER PUBLICATIONS

Saavedra et al. "Self-Oscillating Mixers: A Natural Fit for Active Antennas" Sep./Oct. 2013, IEEE Microwave magazine, pp. 40-49 (Year: 2013).*

(Continued)

*Primary Examiner* — Dameon E Levi
*Assistant Examiner* — David E Lotter

(57) ABSTRACT

A circuit antenna includes an active device, and first and second antennas. The first antenna is connected to an input port of the active device. The first antenna has a first radiation field at an operating frequency of the circuit antenna. The second antenna is connected to an output port of the active device. The second antenna has a second radiation field at the operating frequency. The active device is positioned within the first and second radiation fields to experience an input load matching impedance at the input port and an output load matching impedance at the output port, due to the first and second radiation fields.

15 Claims, 18 Drawing Sheets

(51) Int. Cl.
*H01Q 5/307* (2015.01)
*H01Q 9/04* (2006.01)

(56) References Cited

U.S. PATENT DOCUMENTS

| | | | | |
|---|---|---|---|---|
| 6,876,337 | B2 * | 4/2005 | Larry | H01Q 11/08 343/818 |
| 2005/0099222 | A1 * | 5/2005 | Yang | H03C 3/40 327/404 |
| 2012/0229347 | A1 * | 9/2012 | Jin | H01Q 1/243 343/702 |
| 2013/0321214 | A1 * | 12/2013 | Zhou | H01Q 9/0407 343/700 MS |
| 2015/0123864 | A1 * | 5/2015 | Boryssenko | H01Q 9/16 343/813 |
| 2018/0316100 | A1 * | 11/2018 | Wu | H01Q 25/005 |

OTHER PUBLICATIONS

Chih-Hung Tsai et al, A Novel Amplifying Antenna Array Using Patch-Antenna Couplers-Design and Measurement. IEEE Transactions on Microwave Theory and Techniques, vol. 50, No. 8, Aug. 2002, 8 pages.

I. Waldron et al, Mixing behavior of a dual-patch active antenna oscillator at 1.2 GHz. 2005 IEEE Antennas and Propagation Society International Symposium, Dec. 12, 2005, 4 pages.

Xiao Dong Wu et al, Dual FET Active Patch Elements for Spatial Power Combiners. IEEE Transactions on Microwave Theory and Techniques, vol. 43, No. 1, Jan. 1995, 5 pages.

* cited by examiner

INTEGRATION OF CIRCUIT AND ANTENNA IN FRONT END

FIELD

The present disclosure relates to the field of integrated antennas, particularly in integration of circuits with antennas for radio-frequency (RF) applications, including for use in millimeter wave (mmW) systems.

BACKGROUND

Current, fourth generation wireless communication systems operate at frequencies up to 2.6 GHz. Future generation wireless communication systems are expected to operate at higher frequencies (for example, 30 GHz to 300 GHz), dominantly at millimeter waves (mmW). Advantages of mmW include higher speed, finer resolution, better integration, more compact antenna, and others. However, significant losses due to on-board interconnections, high free space path loss and the effect of radiation from antenna feed networks and circuits are some challenges that need to be addressed for efficient mmW wireless systems.

Conventionally, the architecture of wireless systems involves interconnection of antenna and associated circuits (for example, amplifier) using transmission lines, which are characterized by impedance and other parameters. However, the length of such transmission line interconnections are significant for mmW systems, as it results in severe loss.

Active integrated antenna is another well-known configuration which involves integration of antenna and active circuits on the same board near each other, reducing the interconnections and therefore loss. In rare cases, the antenna functions as a direct load. However, this configuration still has the passive circuitry and interconnections in the vicinity of radiator, affecting the overall radiation performance.

SUMMARY

The present disclosure describes a unique method of integrating circuits with antennas or vice versa for any RF applications over megahertz-through-terahertz, and preferably for use in mmW systems. As illustrated by examples described herein, embodiments of the present disclosure have the potential to replace the conventional antenna front ends in all applications.

In examples disclosed herein the circuit and antenna are integrated together, such that the antenna serves the role of a passive circuit (for example, to provide a specific impedance or impedance matching), and also radiates. Mutual coupling and spacing between the antenna array elements are utilized in realization of such structures. Removal of transmission line interconnections reduces the losses and constructive radiation is achieved by replacing the circuitry with antenna, removing all the circuit components.

In some aspects, the present disclosure describes a circuit antenna. The circuit antenna includes an active device. The circuit antenna also includes a first antenna connected to an input port of the active device, the first antenna having a first radiation field at an operating frequency of the circuit antenna. The circuit antenna also includes a second antenna connected to an output port of the active device, the second antenna having a second radiation field at the operating frequency. The active device is positioned within the first and second radiation fields to experience an input load matching impedance at the input port and an output load matching impedance at the output port, due to the first and second radiation fields.

In any of the preceding aspects/embodiments, the circuit antenna may include, for each antenna, a DC bias portion connected to each respective antenna. The DC bias portion may include at least one source of a DC bias voltage for biasing the active device through the respective antenna or antenna portion.

In any of the preceding aspects/embodiments, the first antenna and the second antenna may be patch antennas.

In any of the preceding aspects/embodiments, the circuit antenna realizes an active circuit, which may be an amplifier.

In any of the preceding aspects/embodiments, there may be a plurality of active devices, and the circuit antenna realizes an active circuit, which may be two or more amplifiers in parallel.

In any of the preceding aspects/embodiments, the first and second antennas may operate simultaneously in multimode, and there may be a plurality of active devices connected between the first and second antennas.

In any of the preceding aspects/embodiments, the circuit antenna may be a multimode amplifier circuit antenna.

In any of the preceding aspects/embodiments, the circuit antenna may be a multimode transceiver circuit antenna.

In any of the preceding aspects/embodiments, each of the first and second antennas may be a dual frequency having two antenna portions, each antenna portion operating at a respective operating frequency, and there may be two active devices, each active device operating at a respective one of the operating frequencies.

In any of the preceding aspects/embodiments, the circuit antenna may be a self-oscillating mixer, wherein the active device experiences a terminating impedance at the input port and a load impedance at the output port, the circuit antenna further comprising a feed line providing input to the first antenna and supporting mixing operation.

In some aspects, the present disclosure describes an array circuit antenna. The array circuit antenna includes a plurality of antenna elements, each antenna element having a respective radiation field at an operating frequency of the circuit antenna. The array circuit antenna also includes at least one active device positioned in a spacing between adjacent antenna elements, the active device having an input port connected to one of the adjacent antenna elements and an output port connected to another of the adjacent antenna elements. The active device is positioned within the radiation fields of the antenna elements to experience an input load matching impedance at the input port and an output load matching impedance at the output port, due to the radiation fields.

In any of the preceding aspects/embodiments, there may be at least one active device positioned in the spacing between each pair of adjacent antenna elements.

In any of the preceding aspects/embodiments, the antenna elements may be arranged in a circular polarization configuration.

In any of the preceding aspects/embodiments, the antenna elements may be arranged in a linear array.

In any of the preceding aspects/embodiments, the antenna elements may be arranged in a two-dimensional array.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1A:
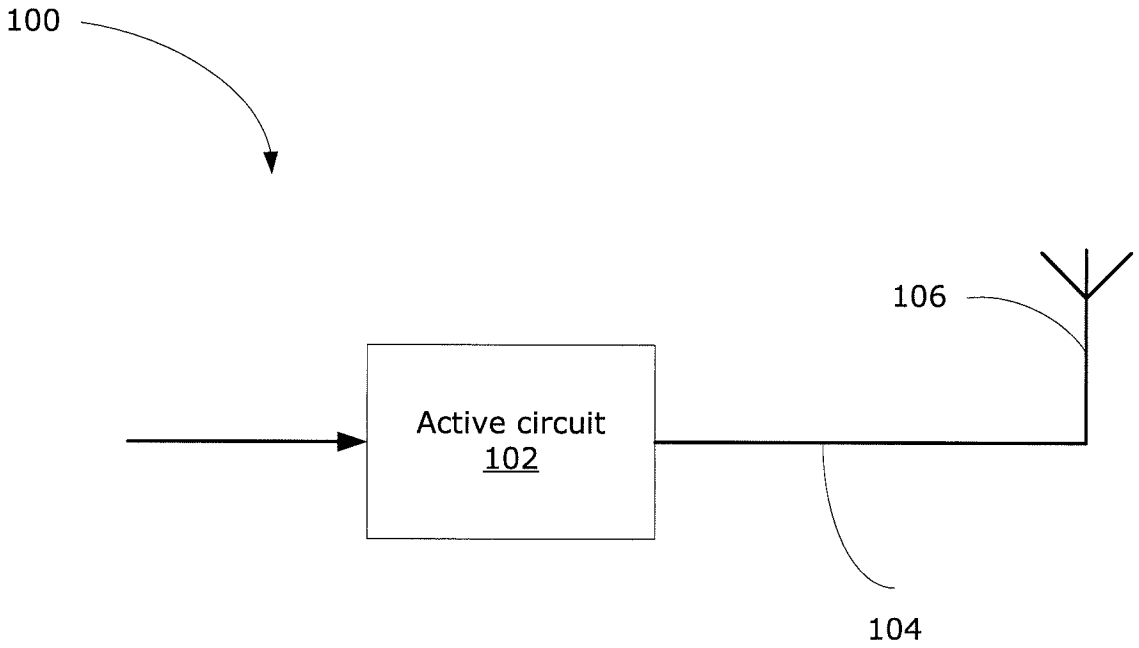
FIG. 1A PRIOR ART
FIG. 1A is a block diagram of an example prior art antenna circuit.

FIG. 1A is a block diagram illustrating an example prior art front end circuit and antenna 100 in a wireless communication system. The circuit 100 includes an active circuit 102 (for example, amplifier) that receives an input signal. Output from the active circuit 102 is sent via transmission lines 104 to the antenna 106 (or array antenna). Generally, the active circuit 102 and the antenna 106 are tuned to a particular impedance and are connected by the transmission lines 104 of the same impedance. Such long transmission line 104 interconnections greatly attenuate the signal at millimeter wave (mmW) frequencies, and generally are not desirable.

Figure 1B:
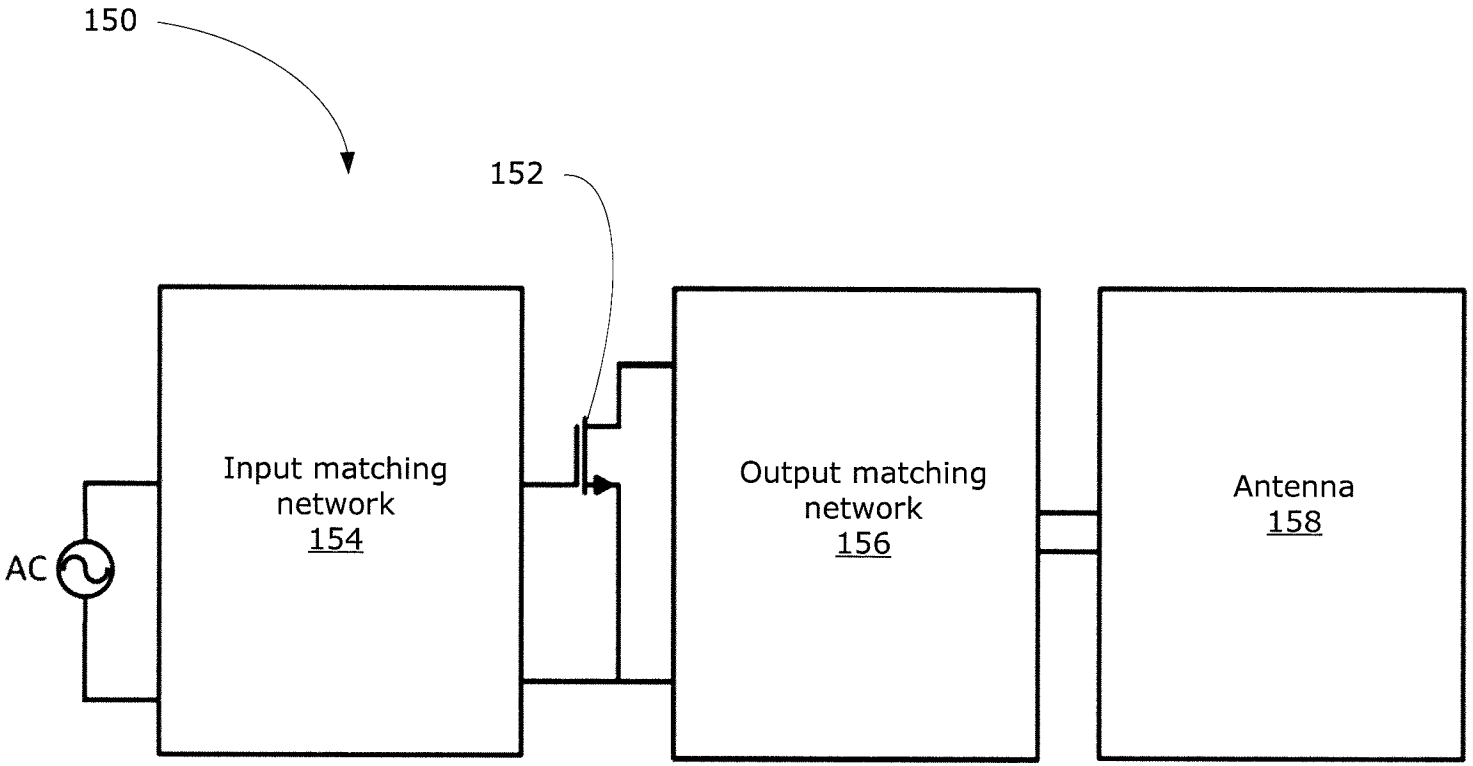
FIG. 1B PRIOR ART
FIG. 1B is a schematic diagram of an example prior art active integrated antenna.

An attempt to address the problem of losses due to interconnections is the active integrated antenna (AIA). In an AIA, the antenna and circuit are on the same board, with reduced interconnections. An example amplifier type circuit 150 for an AIA is shown in FIG. 1B. In this example, the active device 152, in this case a field-effect transistor (FET), is connected on the input side to an input matching network 154 and on the output side to an output matching network 156. The matching networks 154, 156 may be passive circuits that provide load impedances necessary to achieve desired circuit behavior (for example, to avoid signal reflection). For example, the matching networks 154, 156 can each include passive components (not shown) such as capacitors, inductors, resistors or transmission lines in order to achieve the necessary load impedance. The antenna 158 is connected using short interconnections.

In AIAs, the antenna 158 and active circuit are coupled to each other via electromagnetic coupling (not shown). In very few cases, the antenna 158 is the direct load for the active device 152 (not shown). Such a configuration allows the interconnections and output matching network 156 between the antenna 158 and active device 152 to be minimized or removed. However, in mmW systems, the active circuit components 152, 154, 156 are comparable in size to the size of the radiating structure of the antenna 158. The radiation from the active circuit components 152, 154, 156 thus affects the overall radiation performance of the antenna 158, and the radiation from the active circuit components 152, 154, 156 is typically difficult to predict.

In another conventional approach, phased array antennas may be used to remedy the high free space path losses typically experienced in mmW systems. A phased array antenna typically provides large gain, thus increasing the range, and enables beam steering to cover the desired coverage area. However, the feed lines used to excite each radiating element (whether for series feed array or corporate feed array) are comparable in size to that of the radiating element in mmW systems, and have significant effect on the radiation performance of the antenna as well as causing interconnection losses. In an array antenna, spacing between array elements is guided by the beam steering angle necessary or the side lobe levels required. This spacing between array elements is typically fixed and unused, and considered a waste. Mutual coupling between array elements is also commonly considered as a negative effect.

In many current mmW wireless systems, the placement of feed lines and other circuitry is typically on the side of the board opposite to the radiating structure, or on a separate layer from the radiating structure. This is typically done because the feed lines and circuitry affect the radiation performance of the antenna. However, the fabrication and aligning of multiple layers or two-sided boards is time-consuming and costly.

Example circuits disclosed herein may address some shortcomings of conventional antenna circuits discussed above. For example, the disclosed circuits enable radiation from the circuit components to be constructively utilized with the radiation element of the antenna and/or minimizes undesirable circuit radiation. The disclosed circuits may be implemented as planar circuits, which may permit easy and low cost fabrication. Antennas in the disclosed examples perform dual functions, working as circuits in addition to radiators. Mutual coupling can be positively utilized by a proper analysis. Spacing between array elements is utilized to place the active device, thus increasing the integration and reduction of board size. Removal or replacement of interconnections with an active device may reduce loss, compared to conventional antenna front end.

In conventional active circuits (for example, for amplifier, oscillator or mixer circuits), the active device(s) is typically selected and fixed, independently of the antenna, and the desired overall circuit behavior (for example, power transfer function) is achieved by the selection of components for the passive circuit connected to the active circuit. The passive circuit functions as an impedance load at the input and/or output port of the active device, and this impedance serves to tune the overall circuit to the desired behaviour, for example by providing input or output matching for maximum power transfer.

In examples disclosed herein, the use of passive component(s) in tuning the active circuit is replaced by the antenna itself. Because the passive circuit is entirely replaced by the antenna, an antenna configuration is selected that is capable of providing a suitable range of impedances as necessary to achieve the desired overall circuit behaviour. In the present disclosure, patch antennas are used. Patch antennas are useful because they can be printed directly onto a circuit board, are relatively low cost, and can be easily integrated into electronic devices (for example, handheld mobile communication devices). Further, the dimensions and configuration of a patch antenna may be easily adjusted (for example, by changing the feed line and/or radiating structure shape/dimensions) to achieve the desired impedance. Other antenna types and configurations are also suitable.

Figure 2A:
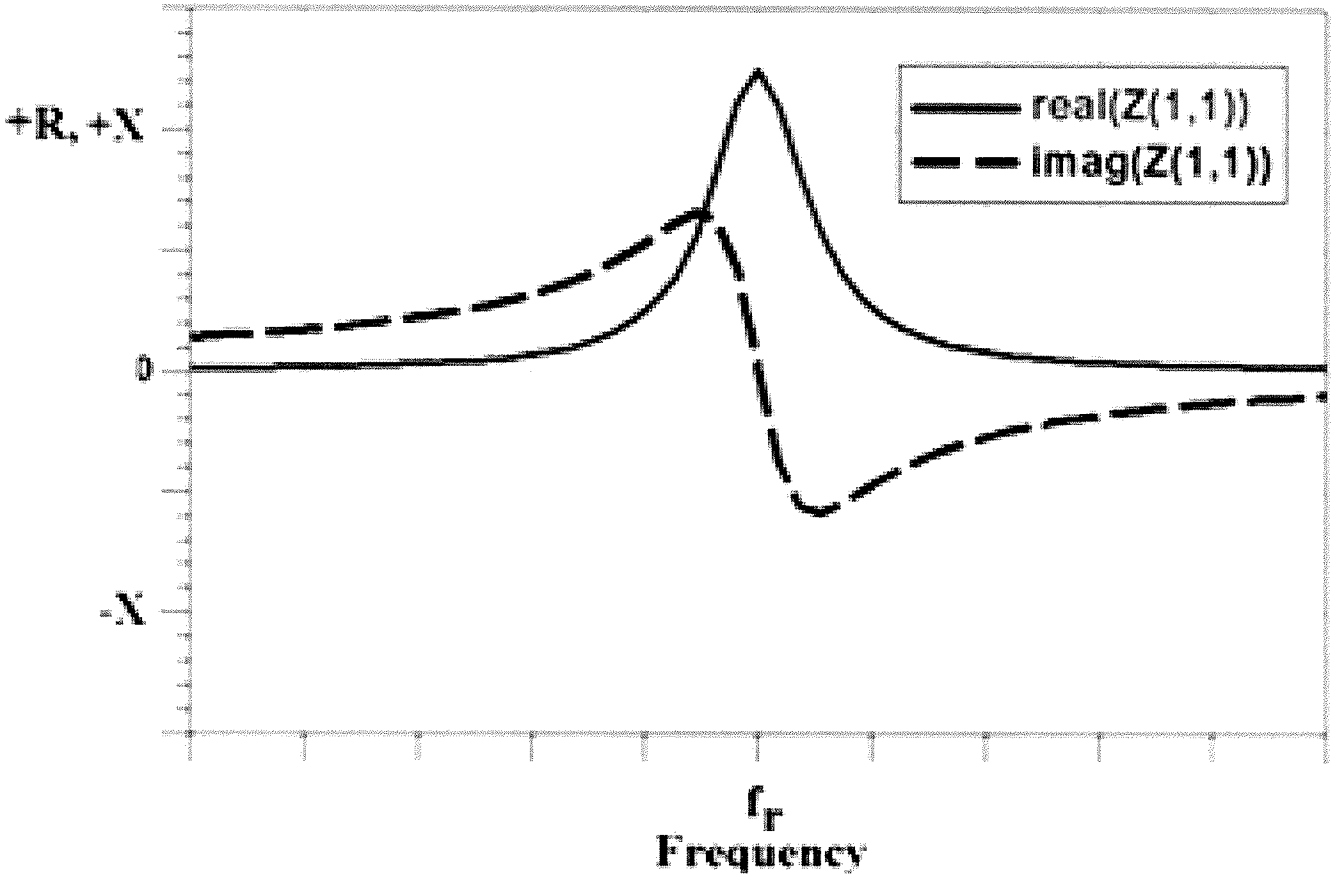
FIGS. 2A and 2B are plots showing the impedance characteristics of an example patch antenna.
Figure 2B:
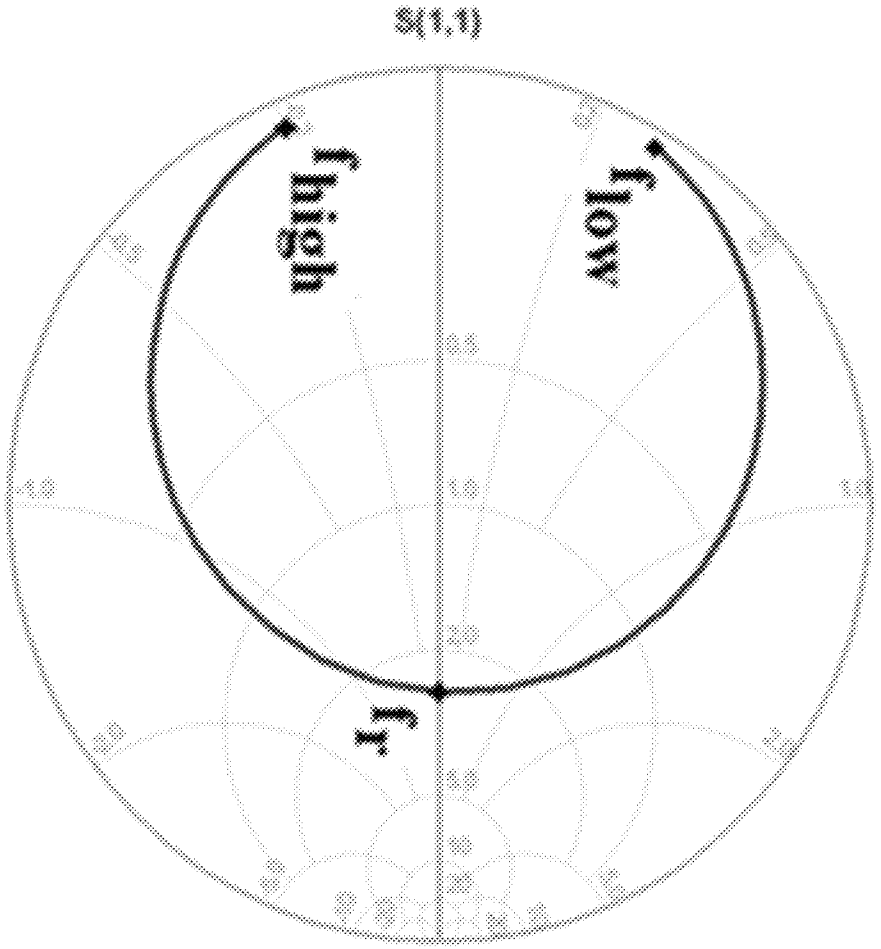

The impedance characteristics of an example rectangular patch antenna are shown in FIGS. 2A and 2B. Other patch antennas may also have similar characteristics. FIG. 2A shows an impedance vs. frequency plot, and FIG. 2B represents this information in a Smith chart. As shown, the impedance of the antenna may be tuned by changing the dimensions of the antenna near the resonant frequency $f_r$ of the antenna. Antenna dimensions are designed at $f_r$, and in general the reactance is zero at $f_r$. Resistance varies from maximum to minimum on either side of $f_r$. With respect to the reactance, on one side, it has inductance and has capacitance on the other side. Increasing the dimension shifts the whole impedance characteristics onto the lower frequency side, achieving capacitance behavior at $f_r$. Decreasing the dimensions shifts the impedance characteristics to the higher frequency side, resulting in inductance behavior at $f_r$. The radiation properties of the antenna remain almost the same near these dimensions around $f_r$. The antenna may provide the desired impedance (for example, for load matching purposes) and yet maintain desired radiation characteristics of the antenna.

To provide matching on both input and output sides of an active device, at least two antenna elements may be used. In this way, passive matching circuits may be entirely omitted, as shown in the example of FIG. 3.

Figure 3:
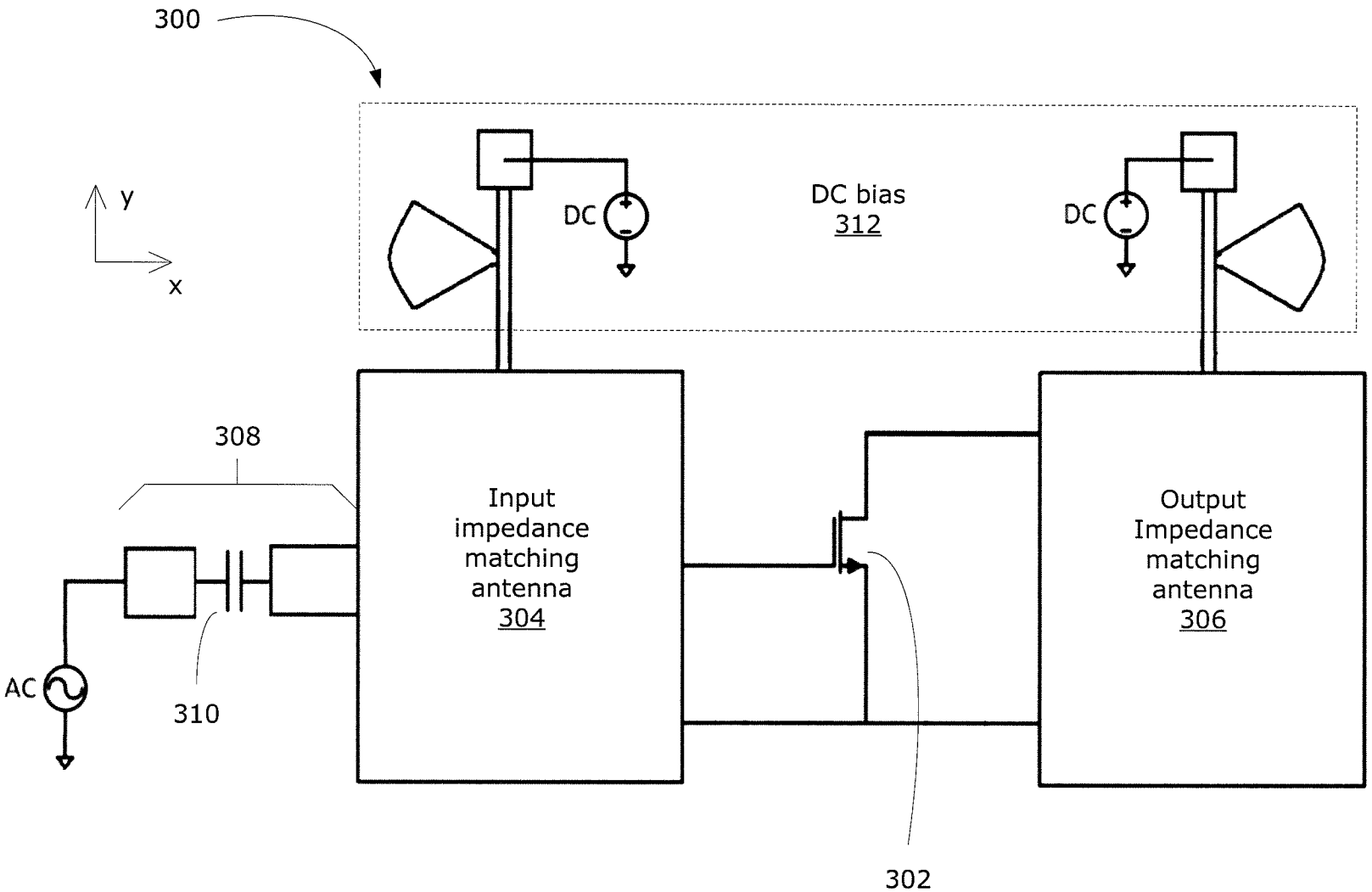
FIG. 3 is an example amplifier circuit antenna using antennas as impedance in addition to radiation.

FIG. 3 is a schematic diagram of an example circuit antenna 300 in which the circuit antenna uses antennas as matching circuits and load impedances, in addition to their function of radiation. In this example, the circuit is an amplifier type circuit with the active device 302 being a FET. The active device 302 is directly connected on the input side to an input impedance matching antenna 304. The active device 302 is also directly connected on the output side to an output impedance matching antenna 306. The input impedance matching antenna 304 serves as both a radiator and as the input matching circuit for the active device 302. Similarly, the output impedance matching antenna 306 serves as both a radiator and as the output matching load circuit for the active device 302. The antennas 304, 306 have an impedance at the desired operating frequency that provides suitable load matching for the active device 302. For example, the output impedance matching antenna 306 provides the impedance necessary for a desired gain in the stable region of the FET. The input impedance matching antenna 304 provides the conjugate impedance matching for maximum power transfer.

In the example shown in FIG. 3, the circuit antenna 300 additionally includes a feed line 308 (connected to an input signal represented as an AC source) and a DC bias portion 312. The feed line 308 in this example includes a DC blocking capacitor 310. The DC bias portion 312 provides adjustable DC bias through the antennas 304, 306 to the active device 302. By adjusting the DC bias voltage, beam steering and frequency tuning of the amplifier circuit antenna 300 may be achieved. The radiation from the active device 302, the feed line 308 and the DC bias portion 312 are also taken into account.

The input and output impedance matching antennas 304, 306 may be considered as individual radiating elements that together form an array antenna. That is, the antennas 304, 306 together form an array antenna having two array elements. In this sense, the example circuit antenna 300 makes use of the spacing between array elements by placing the active device 302 between array elements (i.e., between input and output impedance matching antennas 304, 306). The feed line interconnections that are typically found in conventional array antennas can be omitted by directly connecting the active device 302 at the input and output sides to the input and output impedance matching antennas 304, 306, respectively. Thus, interconnection losses are eliminated. The example circuit antenna 300 has no passive input or output network circuits, and no interconnecting lines, thus reducing the effect of radiation from circuitry and reducing on-board losses.

In a simple implementation, the circuit antenna 300 consists of just the active device 302 with input and output impedance matching antennas 304, 306. In some examples described further below, there may be a greater number of antennas that together form an array antenna having more than two array elements.

In conventional array antennas, mutual coupling between array elements is typically considered undesirable, because it changes the impedance characteristics of the individual element when placed into the array. In the present example, impedance of the input and output impedance matching antennas 304, 306 may be tuned in the presence of mutual coupling (for example, using simulations) between the two antennas 304, 306. Thus, the mutual coupling effect is constructively utilized and explicitly taken into account as a contributing factor.

In the example circuit antenna 300, the load impedance seen by the active device 302 is based on the field emitted by each antenna 304, 306. That is, rather than impedance being based on voltage and current at the input and output ports of the active device 302, the input and output load impedances are due to the radiation field generated by each antenna 304, 306. The load impedance experienced by the active device 302 may thus be dependent on where the active device 302 is placed within the radiation field of the antennas 304, 306. In the example shown, the antennas 304, 306 operate in the dominant mode, in which the field (and hence the impedance) is the same across the width of the patch antenna 304, 306. In this example, the active device 302 is placed at the center to make a symmetrical structure for better radiation performance.

A single mode antenna may serve to both emit radiation and to drive the active circuit. Alternatively, one mode may be used to emit radiation and another mode to drive the active circuit.

Figure 4A:
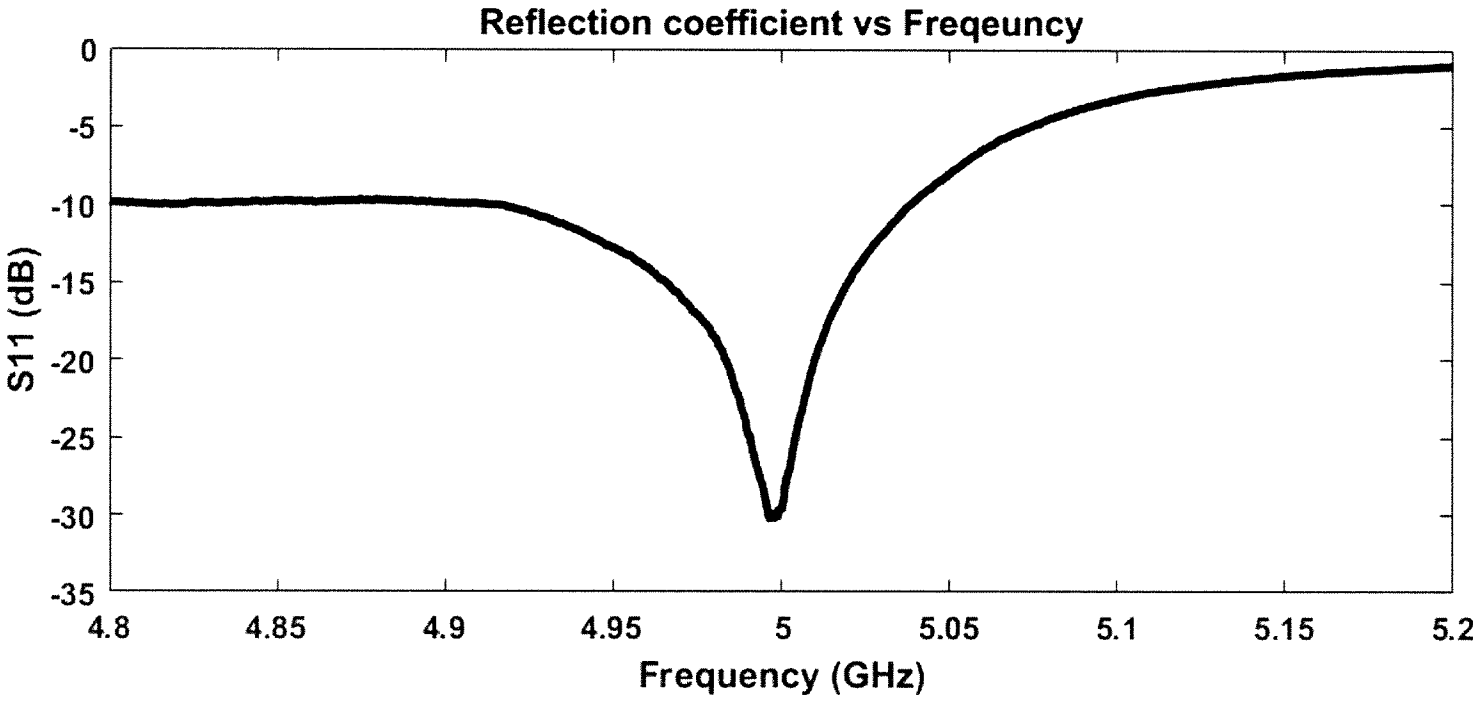
FIGS. 4A and 4B are plots showing measured characterization results for the example circuit of FIG. 3.
Figure 4B:
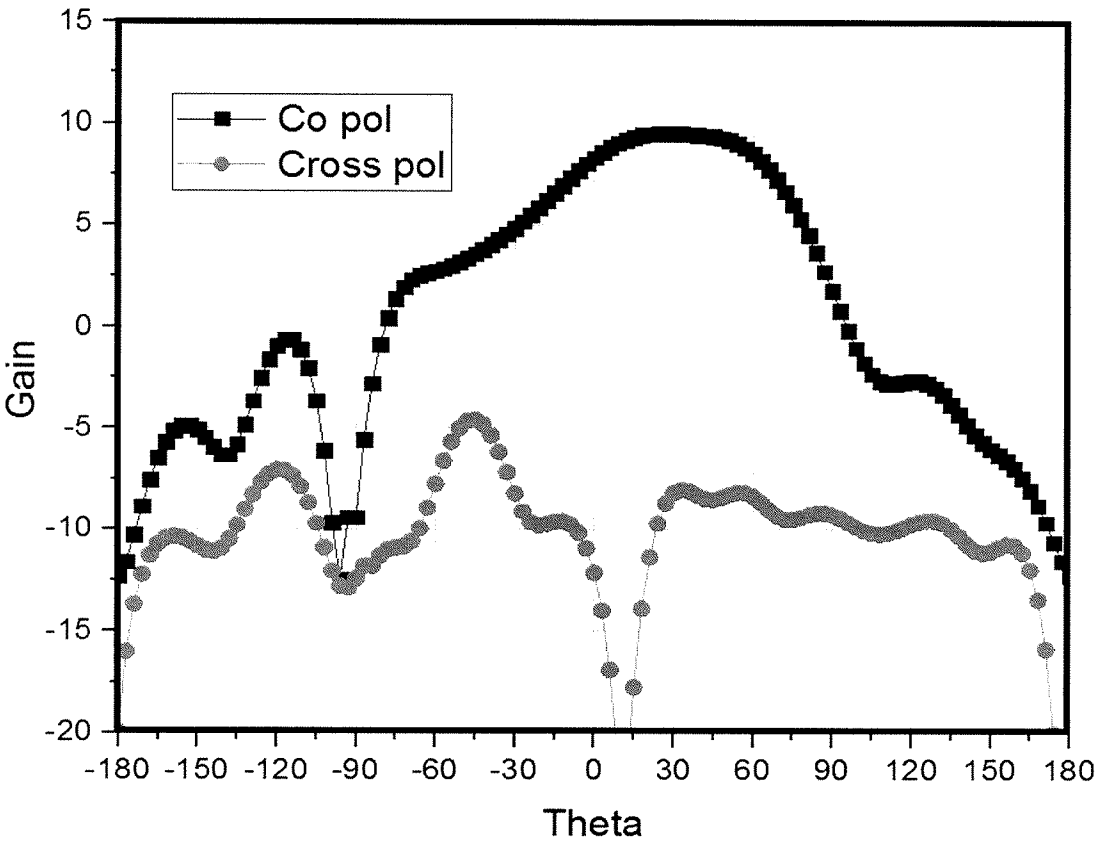

FIGS. 4A and 4B show some results characterizing an implementation of the example circuit antenna shown in FIG. 3. FIG. 4A is a plot of reflection coefficient vs. frequency. The measured efficiency for the example circuit was found to be above 200% at the operating frequency of 5 GHz. FIG. 4B is a plot of gain vs. direction (theta) in co- and cross-polarization at phi=0. This beam steering plot shows that the steering angle is close to the angle calculated from array factor analysis.

The above description provides an example of an amplifier-type circuit antenna with two antennas serving as input impedance matching antenna and output load antenna. The use of antennas as impedance matching networks in the circuit antenna may be similarly implemented for other antenna types and circuit types. For example, in the example shown in FIG. 3, broadband or multiband antennas may be used instead of singleband or narrowband antennas. Bandwidth improvement may be achieved by using different patch configurations for the antennas. For example, E-shaped patch antennas may be used to take advantage of bandwidth improvements.

Figure 5:
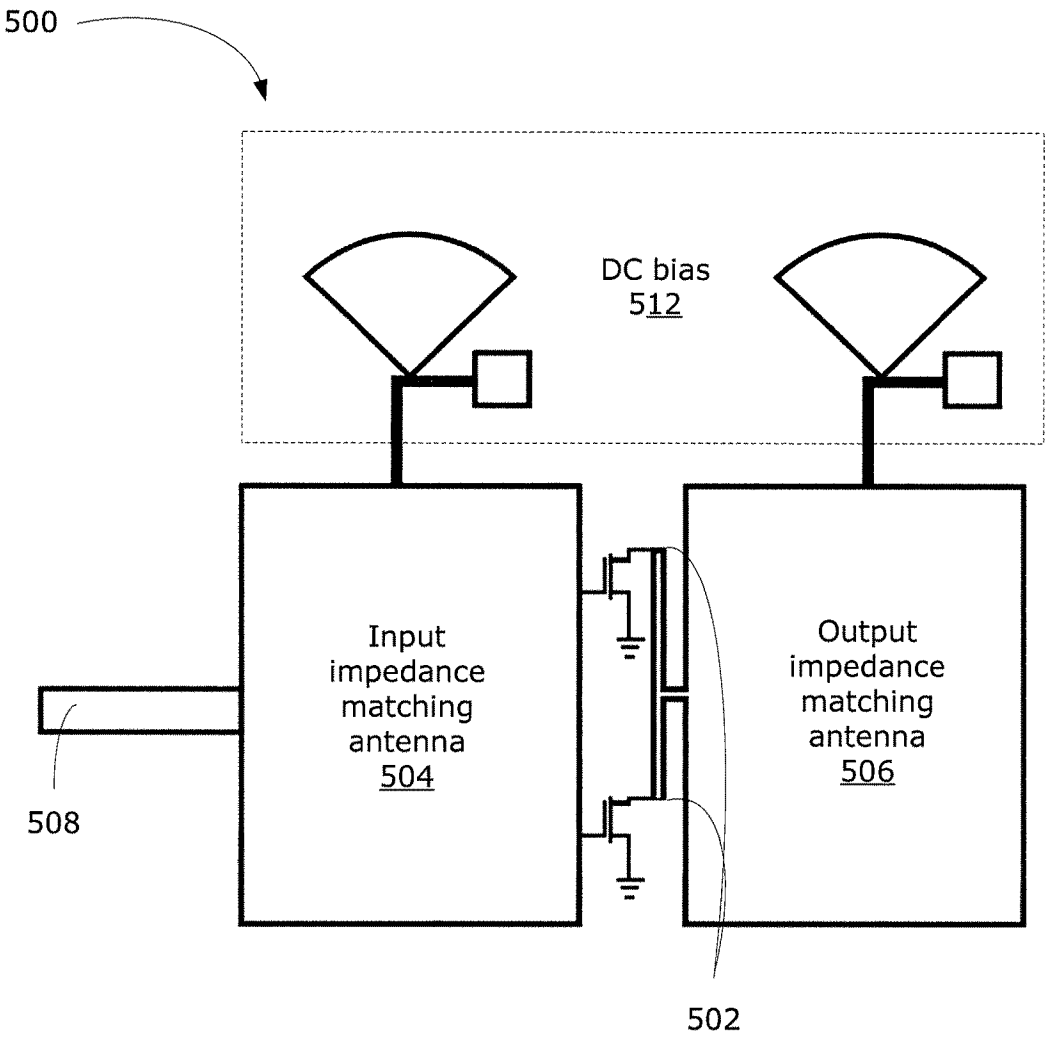
FIG. 5 is a schematic diagram of an example parallel amplifier circuit antenna using antennas as impedance in addition to radiation.

FIG. 5 shows an example parallel amplifier type circuit antenna 500 with impedance matching antennas. The example circuit antenna 500 is similar to the example circuit antenna 300 of FIG. 3, but with parallel active devices 502 in the space between the input and output impedance matching antennas 504, 506. Similarly to FIG. 3, the example circuit antenna 500 includes a feed line 508 and a DC bias portion 512. Input from the feed line 508 is half radiated from the input impedance matching antenna 504, amplified in parallel by the active devices 502 and the added power output is fed to the output impedance matching antenna 506.

Figure 6A:
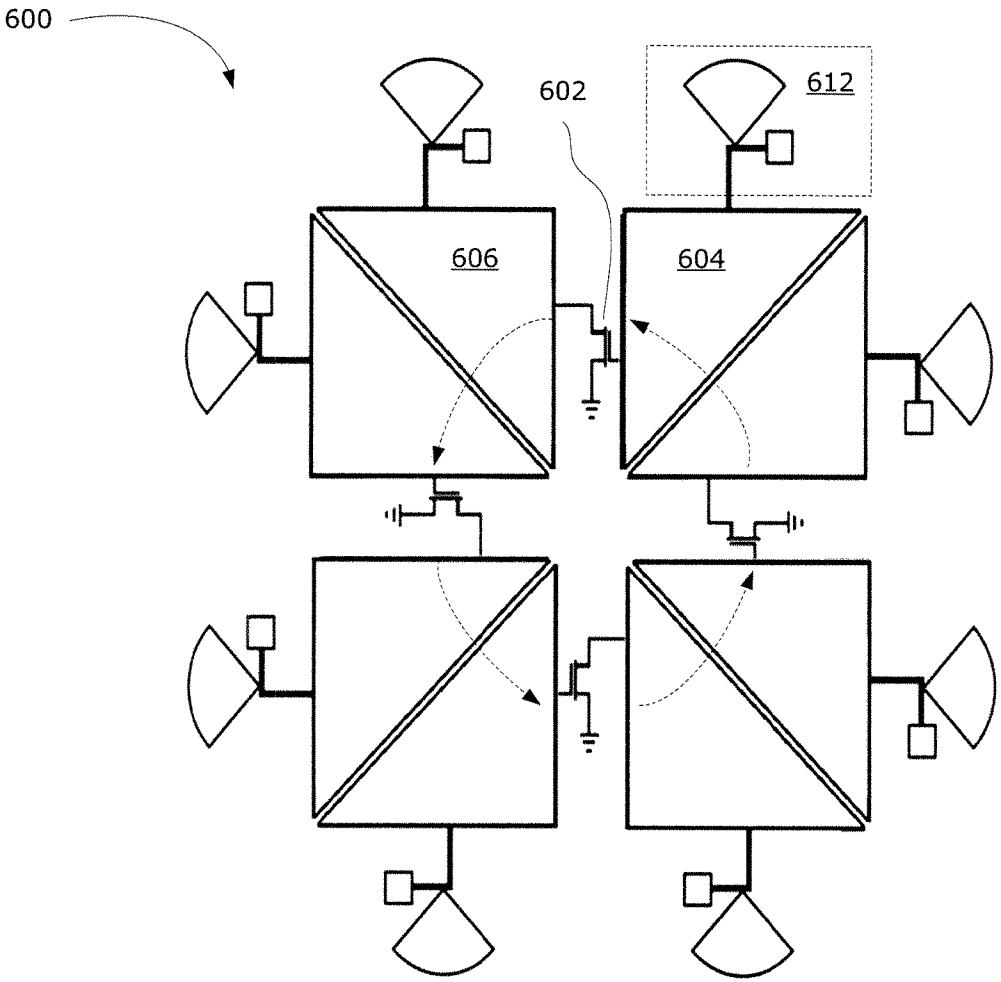
FIGS. 6A and 6B are schematic diagrams of example circularly polarized circuit antennas using antennas as impedance in addition to radiation.

An example circular polarization antenna may also be realized by an oscillator circuit with antennas in a circular fashion, and active devices between antennas. FIG. 6A shows an example circularly polarized oscillator type circuit antenna 600 with impedance matching antennas. For simplicity, only one instance of each component has been labeled. As indicated by the dotted arrows, a signal may be transmitted in circularly arranged impedance matching antennas 604, 606 (each having a respective DC bias portion 612). Each active device 602 is directly connected to the input and output impedance matching antennas 604, 606 at input and output ports of the active device 602, respectively. It should be noted that this configuration is possible because, by using the antennas 604, 606 to function as the matching impedance, there is no need for any further matching network. In conventional circuits, the need for a matching network results in a loss of the interaction between antennas and inability to achieve the circular polarization configuration shown in FIG. 6A.

Figure 6B:
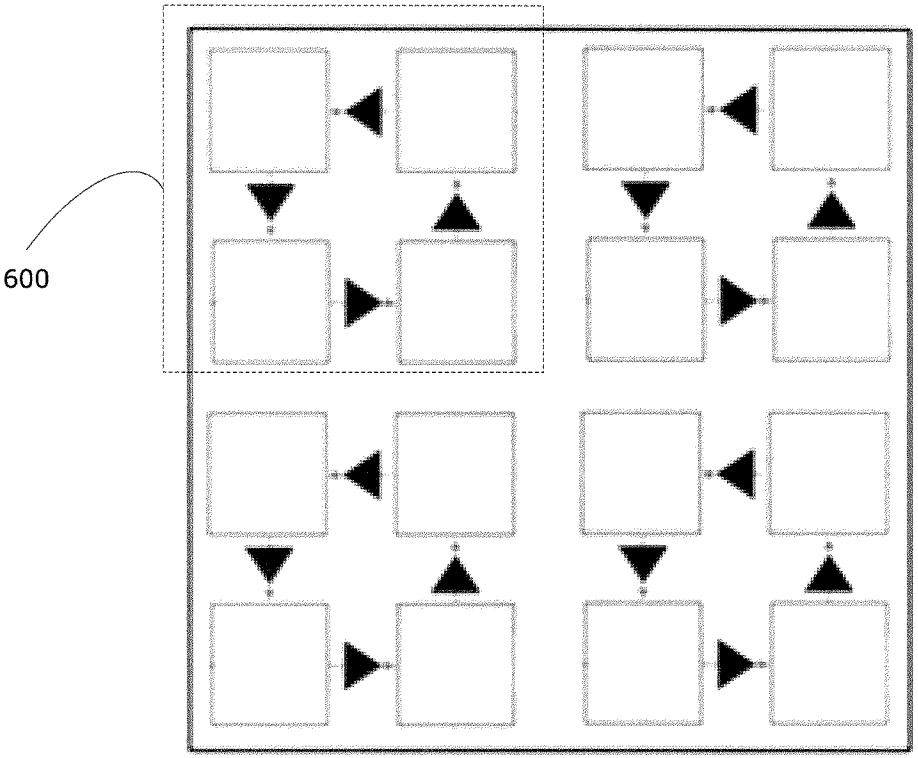

A circular polarization array oscillator may be formed by multiple instances of such circular polarization circuits, based on the concept of sequential rotation. A diagrammatic representation of such a circular polarization array is shown in FIG. 6B, in which multiple instances of the example circuit antenna 600 of FIG. 6A are arranged in an array. This array also provides spatial power combining to achieve higher power levels for transmission with low loss.

Figure 7A:
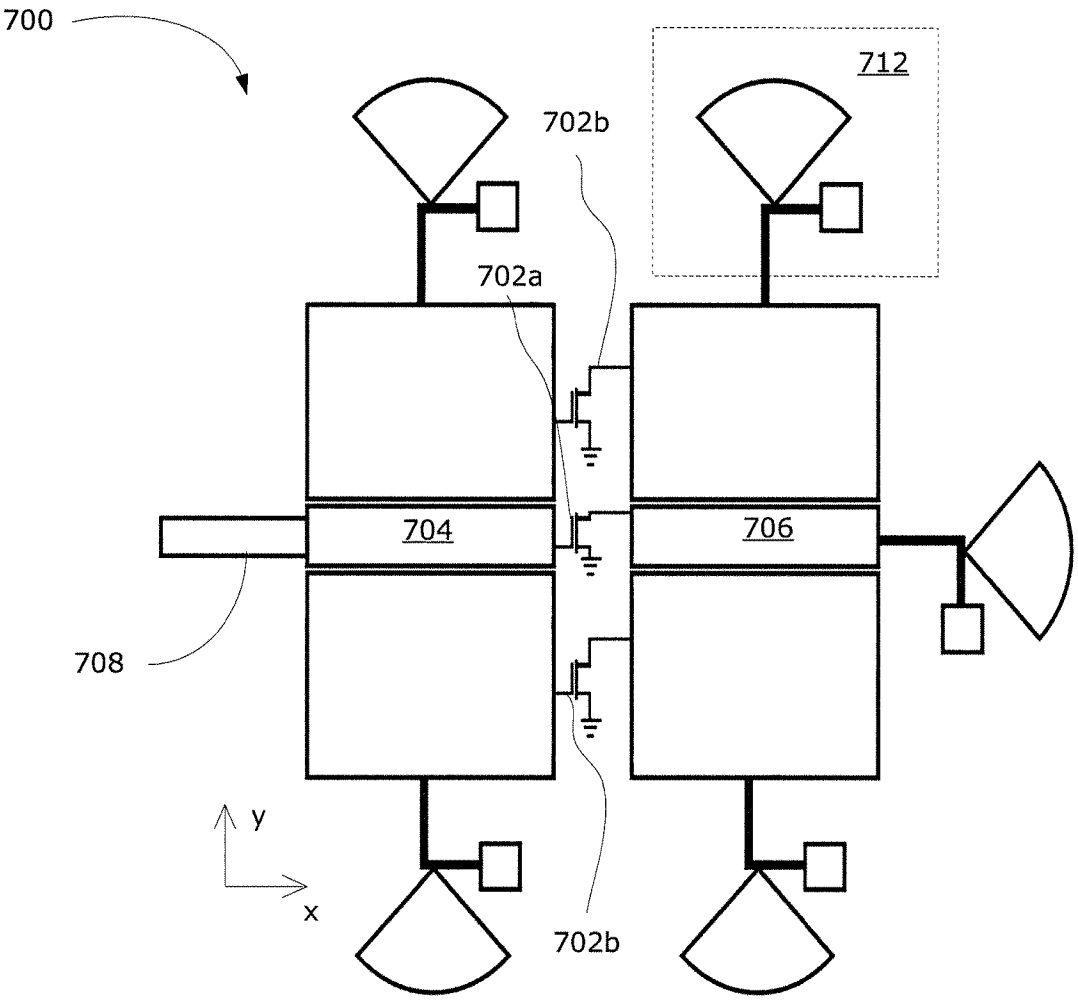
FIGS. 7A and 7B is a schematic diagram of an example multimode amplifier circuit antenna using antennas as impedance in addition to radiation.
Figure 7B:
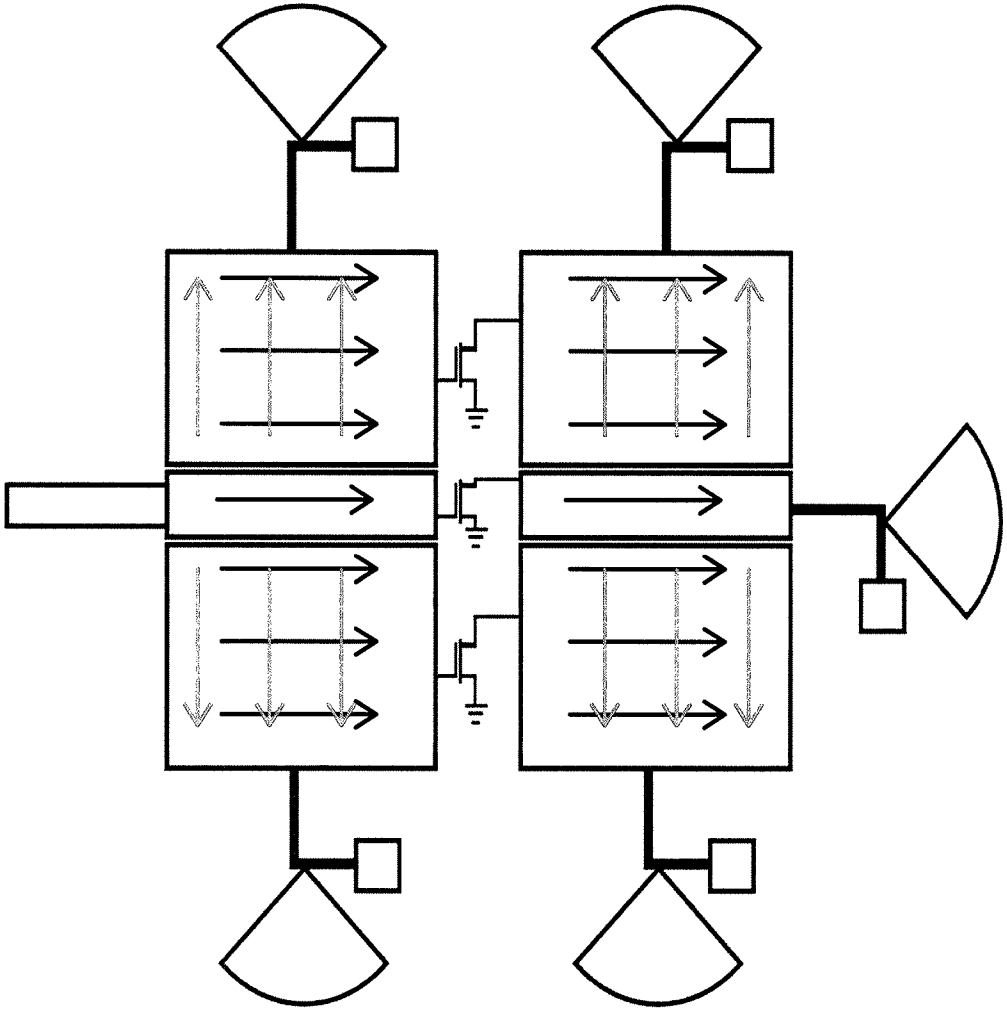

FIG. 7A shows an example multimode parallel amplifier type circuit antenna 700 with impedance matching antennas. In this example circuit antenna 700, active devices 702*a*, 702*b* (in this case, FETs) are in parallel. In the example circuit antenna 700, the impedance matching antennas 704, 706 operates in two different modes simultaneously, one being the dominant mode ($TM_{100}$ in this example) and the other a higher order mode ($TM_{020}$ in this example). It should be noted that although gaps are present in each antenna 704, 706 (making each antenna appear to have three separate portions), these gaps serve to isolate the DC bias, but the portions are electromagnetically coupled at operating frequencies and function as a single antenna. That is, FIG. 7A shows only two antennas 704, 706, each of which includes portions separated by gaps. FIG. 7B illustrates the modes used in this example. DC bias portions 712 are also shown. The middle active device 702*a* is amplifying the dominant mode signal, with the dominant mode operation of the antennas 704, 706 functioning as input impedance matching antenna 704 and output impedance matching antenna 706, respectively. The higher order mode is amplified by the two active devices 702*b* shown at the top and bottom, because the field in this mode is ideally zero at the center using the same antennas 704, 706 as input impedance matching antenna 704 and output impedance matching antenna 706, respectively. A feed line 708 provides both input signal and DC to the input impedance matching antenna 704.

Figure 8:
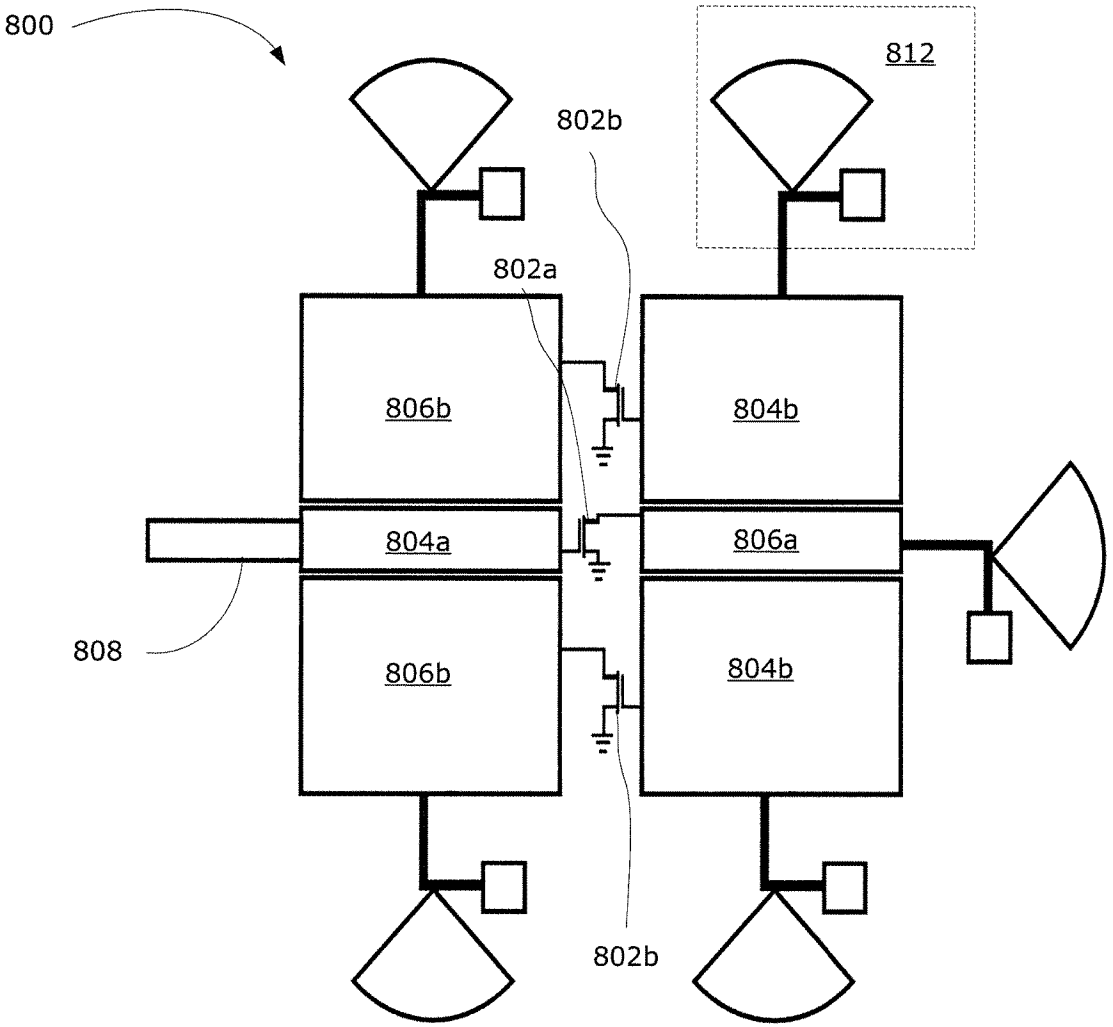
FIG. 8 is a schematic diagram of an example multimode transceiver circuit antenna using antennas as impedance in addition to radiation.

FIG. 8 shows an example multimode transceiver circuit antenna 800 that is similar to the example circuit antenna 700 of FIG. 7A, however the direction of signal in the higher order mode is opposite to the direction of signal in the dominant mode. In this example circuit antenna 800, transmission is achieved in the dominant mode and reception is achieved in the higher order mode. Similarly to FIG. 7A, FIG. 8 shows two antennas, each of which have multiple portions. The transmission part works similar to the example circuit antenna 700 in dominant mode, with antenna portions 804*a*, 806*a* functioning as input impedance matching antenna 804*a* and output impedance matching antenna 806*a*, respectively. The reception part works in opposite direction to the example circuit antenna 700 in higher order mode, with antenna portions 804*b*, 806*b* functioning as input impedance matching antenna 804*b* and output impedance matching antenna 806*b*, respectively. Similar to the example circuit antenna 700, the example circuit antenna 800 includes active devices 802*a*, 802*b* in parallel and DC bias portions 812 for the respective antenna portions 806*a*, 804*b*, 806*b*. The feed line 808 is used to input the transmission signal, receive the incoming signal and also provide the DC bias for the active device 802*a* through antenna portion 804*a* simultaneously.

Figure 9:
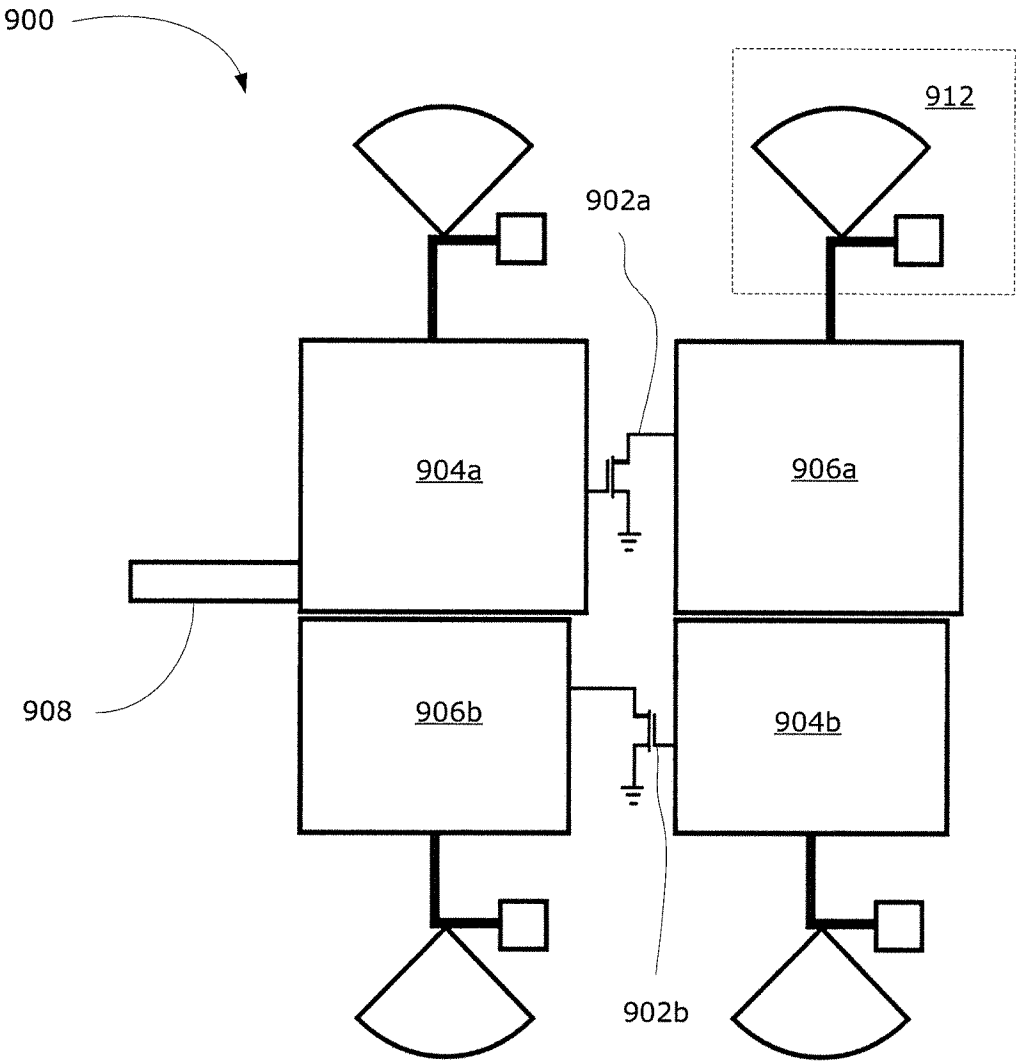
FIG. 9 is a schematic diagram of an example multi-frequency transceiver circuit antenna using antennas as impedance in addition to radiation.

FIG. 9 shows an example dual frequency amplifier type transceiver circuit antenna 900 with impedance matching antennas. The example circuit antenna 900 includes dual frequency antenna 904*a*, 904*b*, 906*a*, 906*b*, with a first set of antenna portions 904*a*, 906*a* having a first operating frequency, and a second set of antenna portions 904*b*, 906*b* having a second operating frequency, with respective DC bias portions 912. In the example circuit antenna 900, transmission is performed by first set of antenna portions 904*a*, 906*a* at the first operating frequency and reception of signal is performed by the other set of antenna portions 904*b*, 906*b* at the second operating frequency. In this example, the active devices 902*a*, 902*b* are positioned oppositely faced for transceiver operations. A feed line 908 provides input to the first set of antennas 904*a*, 906*a* and receives signal from the second set of antennas 904*b*, 906*b*.

Figure 10:
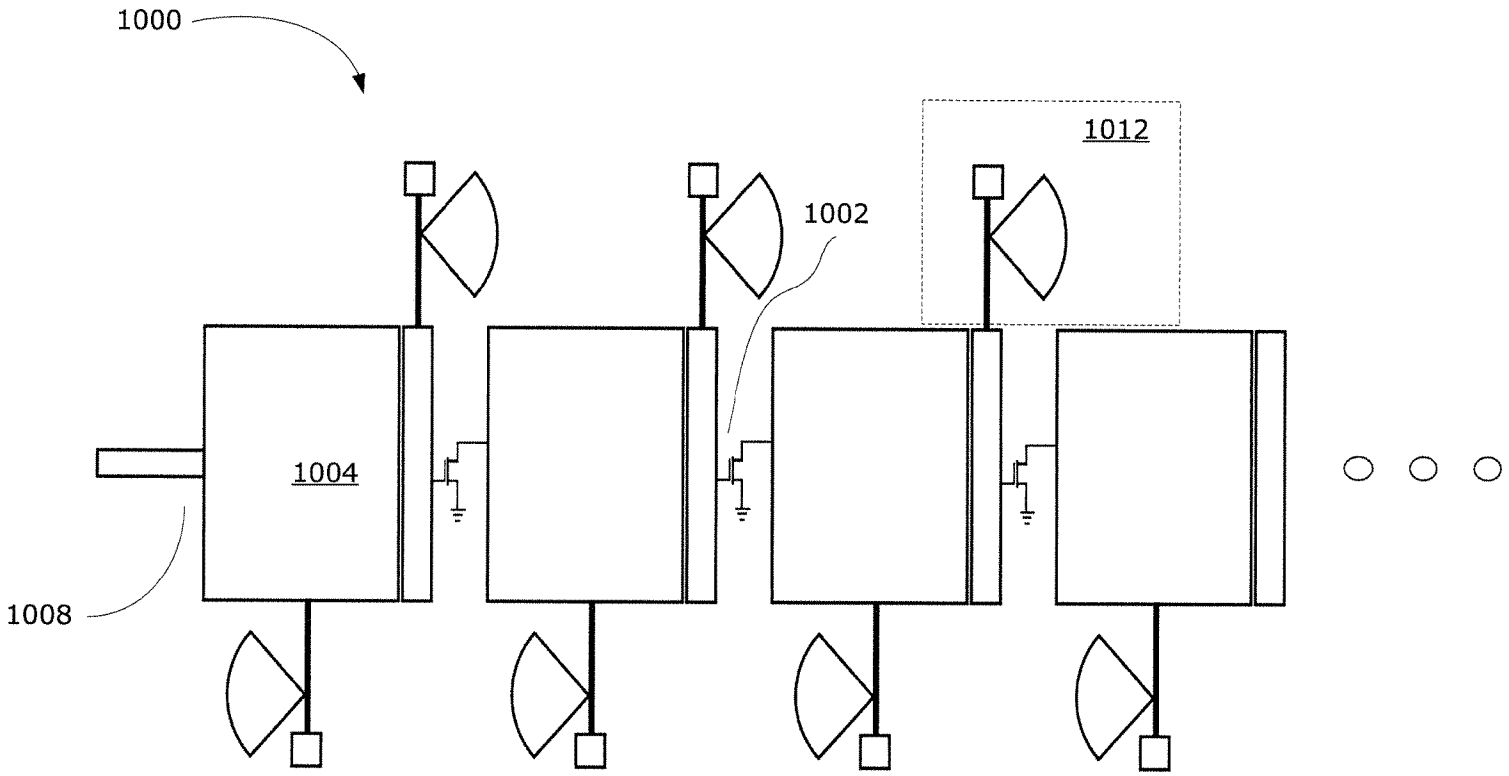
FIG. 10 is a schematic diagram of an example amplifier circuit linear array circuit antenna in which antennas are used as impedance in addition to radiation.

Linear array antennas may be implemented using the disclosed circuit antennas with impedance matching antennas. An example of a linear amplifier circuit antenna with impedance matching antennas is shown in FIG. 10. A feed line 1008 provides input to the array of antennas 1004. Notably, the active device 1002 is positioned in the conventionally unused space between array elements. Respective DC bias portions 1012 provide DC bias to each antenna 1004. By changing the DC bias of each antenna 1004, it is possible to achieve beam steering, shaped beam forming, and frequency tuning, without requiring additional phase shifters and amplifiers. That is, any tuning and re-configurability that is conventionally provided by additional circuit elements may instead be performed by controlling DC bias of the antennas 1004, thus omitting the need for the additional elements. In some examples, the active device 1002 may, instead of a transistor as shown in FIG. 10, be a phase shifter, thus obtaining a linear phase shifter array antenna. In other samples, the impedance matching antennas may be arranged to obtain a linear oscillator circuit array antenna.

Figure 11:
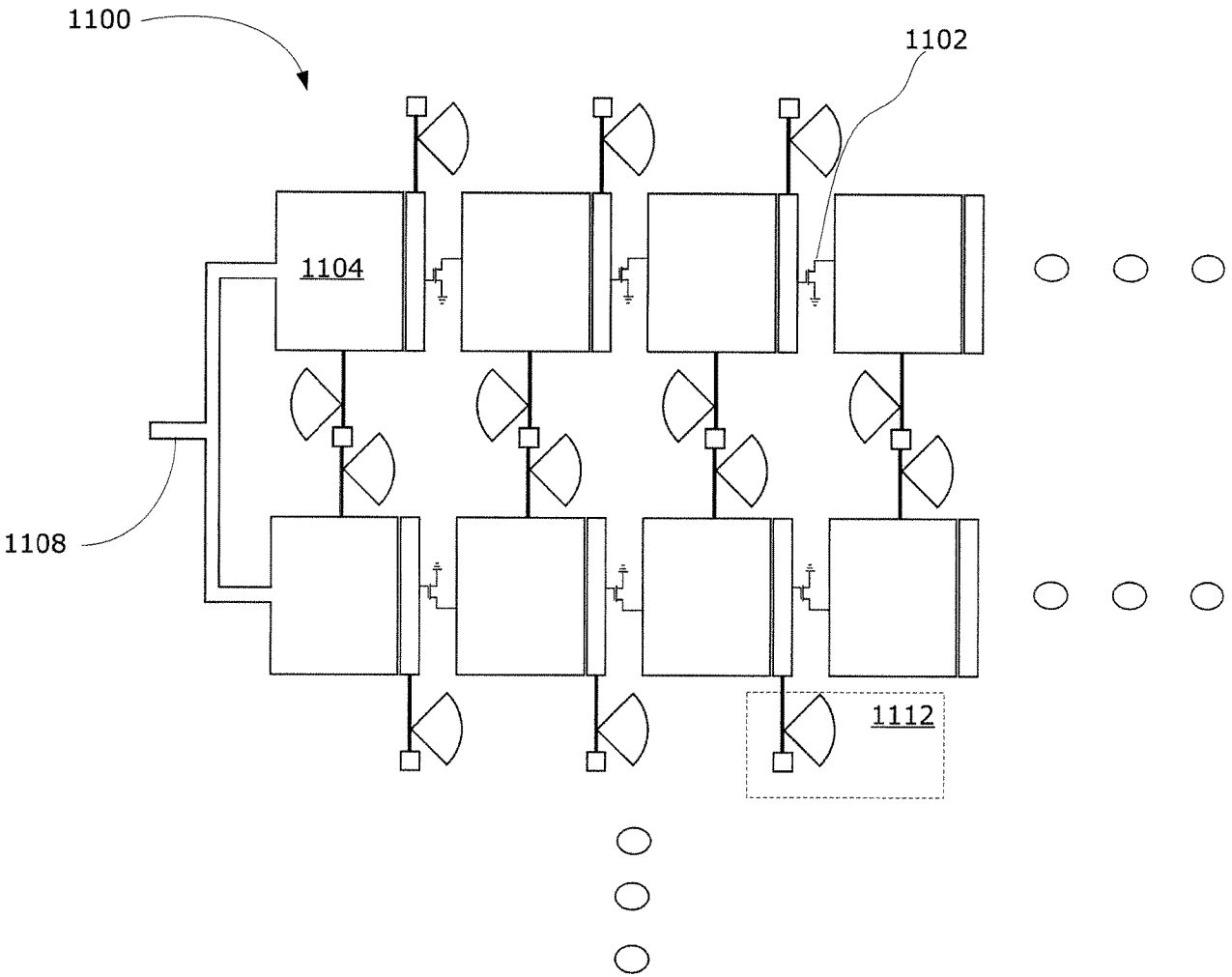
FIG. 11 is a schematic diagram of an example two-dimensional amplifier circuit array antenna in which antennas are used as impedance in addition to radiation.

FIG. 11 shows an example 2D array circuit antenna 1100 implemented using impedance matching antennas. A feed line 1108 provides input to the array of antennas 1104. Notably, active devices 1102 are positioned in the conventionally unused space between array elements 1104. Respective DC bias portions 1112 provide DC bias to each antenna 1104. Similar to the example linear array described above with respect to FIG. 11, beam steering, beam forming and frequency tuning may be achieved by changing the DC bias of the antennas 1104. In some examples, a phase shifter (not shown) may be added at one end to provide further beam steering capabilities.

Figure 12:
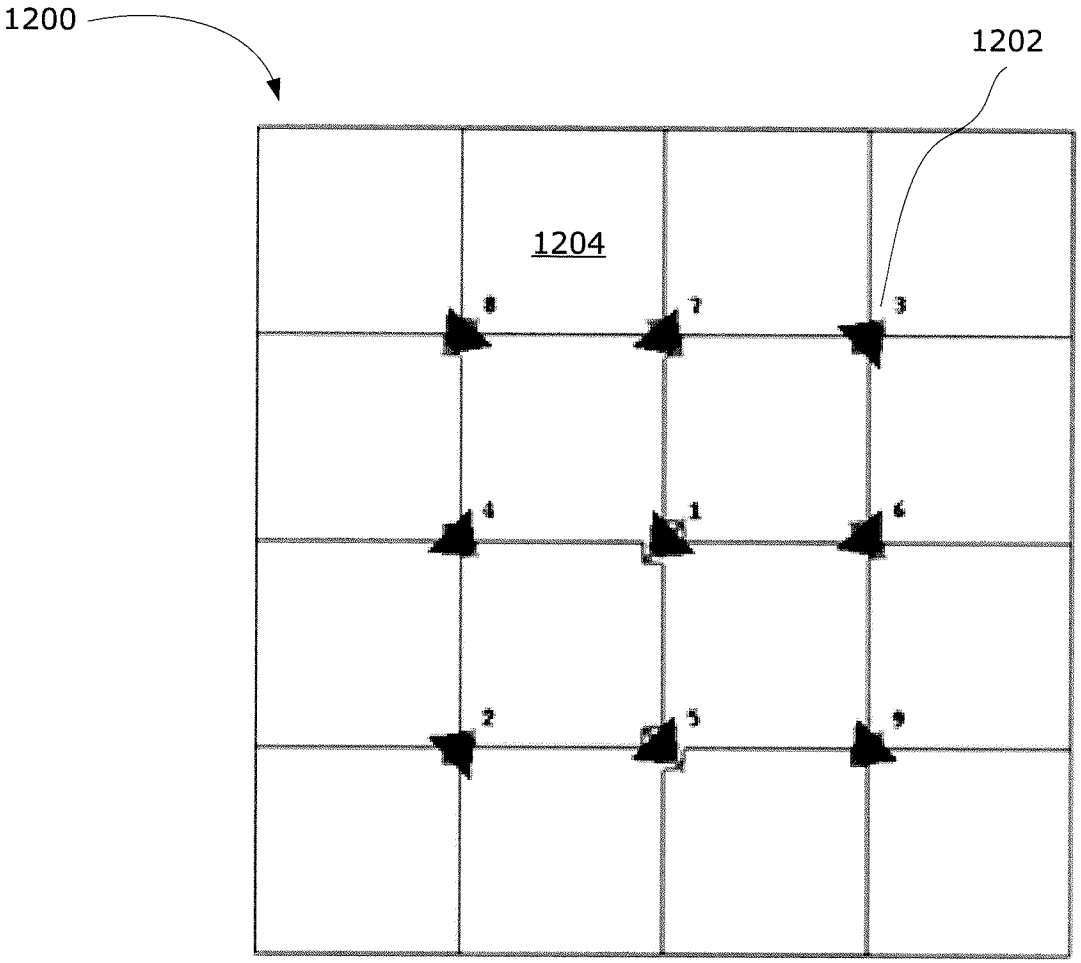
FIG. 12 is a schematic diagram of an example array of complementary circuit antennas in which antennas are used as impedance in addition to radiation.

The present disclosure may also be implemented using complementary antennas, which may provide wide band operation with possible reconfigurable features. FIG. 12 is a diagrammatic representation of an example implementation using complementary antennas. In the example circuit antenna 1200, active devices 1202 are terminated by the antennas 1204 on input and output sides to provide the desired circuit operation. Amplifier type or oscillator type circuit behavior may be obtained with wide bands for such configurations. It is also expected that switching behavior may be achieved by proper bias, which helps in achieving reconfigurable radiation patterns. Each antenna 1204 has a DC bias connected, however the DC bias is not shown for simplicity in representation. The feed (not shown) to achieve an amplifier type circuit complementary antenna may be at any corner, with active devices 1202 placed accordingly.

Figure 13:
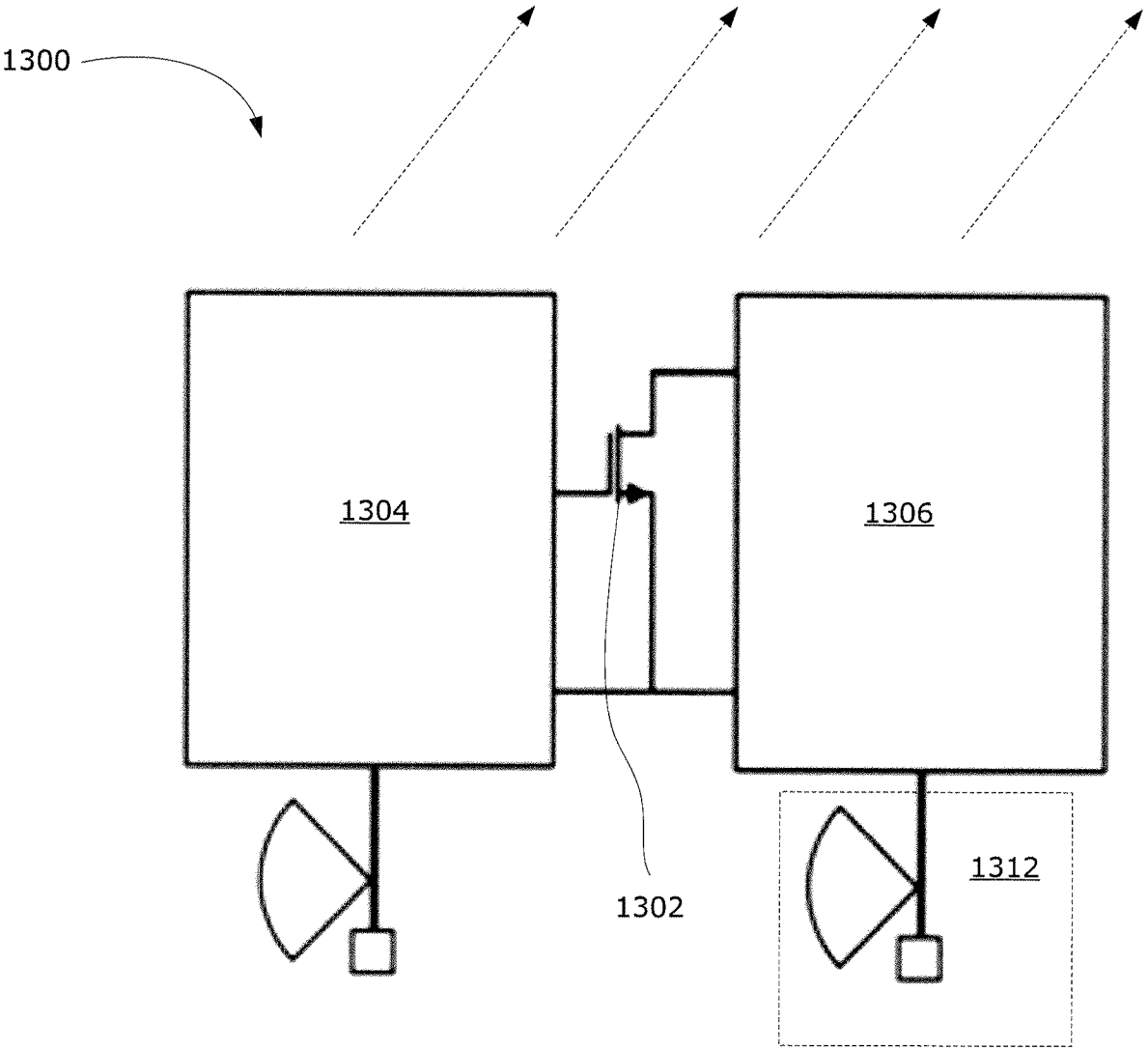
FIG. 13 is a schematic diagram of an example oscillator circuit antenna using antennas as impedance in addition to radiation.

Other types of circuits that may be implemented using integrated circuit antennas include oscillator type circuit antennas, self-oscillating mixer type circuit antennas, reconfigurable antennas and retro directive antennas, among others. FIG. 13 shows an example oscillator type circuit antenna 1300 in which a first antenna 1304 serves as the terminating impedance and a second antenna 1306 serves as the load impedance. An active device 1302 is connected between the antennas 1304, 1306. The circuit antenna 1300 emits a RF signal represented by dotted arrows. The example circuit antenna 1300 of FIG. 13 may be adapted to be a self-oscillator mixer type by addition of a feed line providing input to the first antenna 1304 and supporting the mixing operation.

The examples disclosed herein may be suitable for use in various systems and devices for wireless communications, including for mmW systems and/or where a more compact antenna circuit is desired. For example, disclosed example circuits may be implemented in mobile communication devices, computing devices with wireless communication capabilities, internet of things (IoT) devices or handheld wireless devices, among others.

In some examples, the present disclosure provides an array antenna that provides an alternative way of feeding the array by using the active circuit elements as the connection between array elements. In example array antennas disclosed herein, the space between array elements may be utilized, to enable development of more compact and integrated communication architecture. Further, mutual coupling between array elements may be used in a positive way.

The integrated circuit antennas disclosed herein, in some examples, may be implemented using one-sided, one-layer planar structures, which may be preferable for easier fabrication and mass production for commercial usage, and may be more cost effective. The examples disclosed herein use planar antennas, including patch antennas. However, other antenna types can be used. Different configurations and dimensions of antennas may be used for different applications.

The disclosed examples remove interconnections, thus minimizing losses. As well, the integration of the circuit with the antenna enables radiation from the circuit to be used constructively. Efficiency may also be improved.

Although the present disclosure provides examples in the context of mmW for 5G communication systems, examples disclosed herein may be applicable to other wireless communications, including current generation systems.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

The invention claimed is:

1. A circuit antenna comprising:

an active device;

a first antenna connected directly to an input port of the active device, the first antenna having a first radiation field at an operating frequency of the circuit antenna; and a second antenna connected directly to an output port of the active device, the second antenna having a second radiation field at the operating frequency;

wherein the active device is positioned within the first and second radiation fields to experience an input load matching impedance at the input port and an output load matching impedance at the output port, due to the first and second radiation fields.

2. The circuit antenna of claim 1, further comprising, for each antenna, a DC bias portion connected to each respective antenna, the DC bias portion including at least one source of a DC bias voltage for biasing the active device through the respective antenna.

3. The circuit antenna of claim 1, wherein the first antenna and the second antenna are patch antennas.

4. The circuit antenna of claim 1, wherein the circuit antenna realizes an active circuit, which is an amplifier.

5. The circuit antenna of claim 4, wherein there is a plurality of active devices, and the active circuit realized is two or more amplifiers in parallel.

6. The circuit antenna of claim 1, wherein the first and second antennas operate simultaneously in multimode, and wherein there is a plurality of active devices connected between the first and second antennas.

7. The circuit antenna of claim 6, wherein the circuit antenna is a multimode amplifier circuit antenna.

8. The circuit antenna of claim 6, wherein the circuit antenna is a multimode transceiver circuit antenna.

9. The circuit antenna of claim 1, wherein each of the first and second antennas is a dual frequency having two antenna portions, each antenna portion operating at a respective operating frequency, and wherein there are two active devices, each active device operating at a respective one of the operating frequencies.

10. The circuit antenna of claim 1, wherein the circuit antenna is a self-oscillating mixer, wherein the active device experiences a terminating impedance at the input port and a load impedance at the output port, the circuit antenna further comprising a feed line providing input to the first antenna and supporting mixing operation.

11. An array circuit antenna comprising:

a plurality of antenna elements, each antenna element having a respective radiation field at an operating frequency of the circuit antenna; and at least one active device positioned in a spacing between adjacent antenna elements, the active device having an input port directly connected to one of the adjacent antenna elements and an output port directly connected to another of the adjacent antenna elements;

wherein the active device is positioned within the radiation fields of the antenna elements to experience an input load matching impedance at the input port and an output load matching impedance at the output port, due to the radiation fields.

12. The circuit antenna of claim 11, wherein the plurality of antenna elements comprises at least one pair of adjacent antenna elements, and wherein there is at least one active device positioned in the spacing between each pair of adjacent antenna elements.

13. The circuit antenna of claim 11, wherein the antenna elements are arranged in a circular polarization configuration.

14. The circuit antenna of claim 11, wherein the antenna elements are arranged in a linear array.

15. The circuit antenna of claim 11, wherein the antenna elements are arranged in a two-dimensional array.

* * * * *